US005389757A

United States Patent [19]

Souliere

[11] Patent Number: 5,389,757

[45] Date of Patent: Feb. 14, 1995

[54] ELASTOMERIC KEY SWITCH ACTUATOR

[75] Inventor: Ernest G. Souliere, Rochester, N.H.

[73] Assignee: Digital Equipment Corporation, Maynard, Mass.

[21] Appl. No.: 210,099

[22] Filed: Mar. 16, 1994

Related U.S. Application Data

[62] Division of Ser. No. 77,830, Jun. 15, 1993, abandoned.

[51] Int. Cl.[6] ..... H01H 3/12

[52] U.S. Cl. ..... 200/345; 200/513; 200/517; 200/521; 200/406

[58] Field of Search ..... 200/517, 513, 521, 345, 200/406, 402

[56] References Cited

U.S. PATENT DOCUMENTS

| | | | |
|---|---|---|---|
| 3,829,646 | 8/1974 | Lorteije et al | 200/513 |
| 3,932,722 | 1/1976 | Obata et al. . | |
| 4,117,292 | 9/1978 | Hayes et al. . | |
| 4,127,758 | 11/1978 | Lowthorp . | |
| 4,289,943 | 9/1981 | Sado . | |
| 4,390,765 | 6/1983 | Sado et al. . | |
| 4,518,833 | 5/1985 | Watkins | 200/513 X |
| 4,584,444 | 4/1986 | Nagashima . | |
| 4,604,509 | 8/1986 | Clancy et al. . | |
| 4,677,268 | 6/1987 | Nemeth et al. . | |
| 4,814,561 | 3/1989 | Kawasaki | 200/513 |
| 5,203,448 | 4/1993 | Osada et al. | 200/517 |

FOREIGN PATENT DOCUMENTS

| | | | |
|---|---|---|---|
| 264125 | 10/1989 | Japan | 200/517 |

*Primary Examiner*—Ernest G. Cusick

*Attorney, Agent, or Firm*—Ronald C. Hudgens; Barry N. Young; Albert P. Cefalo

[57] ABSTRACT

A key switch and resilient actuator assembly that includes an electrical switching region and a hollow open ended actuator cover of elastomeric material overlaying the switching region with the open end of the actuator cover in surrounding relationship with the switching region. The actuator cover includes a first wall portion shaped to provide substantially linear resistive force during compression displacement of the cover toward the switching region and to provide substantially linear restoring force during expansion displacement of the actuator cover away from the switching region. The actuator cover further includes a second wall portion shaped to undergo buckling toward the switching region at a predetermined compression displacement and to undergo unbuckling away from the switching region at a predetermined expansion displacement that is smaller in total displacement than the predetermined compression displacement. The actuator cover also includes an interior portion positioned and sized to move into the switching region at the buckling of the second wall portion and to move out of the switching region at the unbuckling of the second wall portion.

4 Claims, 8 Drawing Sheets

ELASTOMERIC KEY SWITCH ACTUATOR

This application is a division of application Ser. No. 08/077,830, filed Jun. 15, 1993, now abandoned.

BACKGROUND OF THE INVENTION

This invention relates to key switching and more particularly to a resilient key switch actuator and assembly that provides a tactile feel to an operator.

Individual key switches and keyboards using them find wide use in such diverse product applications as data input terminals, typewriters, computer keyboards, cash registers, and calculators. Individual keys usually have alphanumeric characters or other symbols inscribed on them. When an operator depresses a key, its associated key switch closes a circuit. And the closed circuit provides an electric output that may be stored or that may cause performance of some operation, such as issuing a character.

It is highly desirable to provide key switches with a resilient actuator arrangement that provides a tactile feel to an operator during a key stroke. This tactile feel is established by a key switch using a resilient actuator that effects a steep drop-off in reactive or resistive force. This drop-off indicates to an operator that switch closing or triggering has been made.

At present there are three major approaches to resilient key switch actuator arrangements. The operation of these approaches is generally indicated in the three force displacement curves shown in FIGS. 1–3.

FIG. 1 shows a force displacement curve for a keyboard key switch using what is referred as a linear type actuator arrangement. As indicated in FIG. 1, reactive or resistive force increases at a particular slope from point "a" to point "b" as an operator depresses a key. At point "b" switch triggering begins. Thereafter, reactive force continues to increase with compression displacement from points "b" to "c", but at an increased slope. As the operator releases the key, restoring force of the actuator moves the actuator in expansion toward its initial position generally along the same curve, but in the opposite direction.

FIG. 2 shows a force displacement curve for a keyboard key switch using what is referred to as a tactile type actuator arrangement. As indicated in FIG. 2, reactive or restive force typically increases from point "a" to a maximum resistive force location at point "b" as an operator depresses a key. At location "b" reactive force drops-off quickly (tactile drop-off) with a small amount of displacement to provide the operator with a tactile feel. The tactile drop-off continues until switch triggering begins at point "c". Thereafter, reactive force continues to increase with compressive displacement from point "c" to point "d". As the operator begins to release the key, restoring force moves the arrangement in expansion toward its initial position generally along the same curve, but in the opposite direction.

FIG. 3 shows a force displacement curve for a keyboard key switch using what is referred to as a hysteresis type actuator arrangement, which represents the third major approach. As indicated in FIG. 3, reactive force increases in a substantially linear way from point "a" to a point of maximum reactive force at point "b" as an operator depresses a key. At point "b" reactive force plummets or vertically drops-off to point "c" with little, if any, further displacement. This precipitous tactile drop-off provides the operator with a pronounced tactile feel. And at point "c" switch triggering begins. Thereafter, reactive force increases as the operator continues compression displacement from point "c" to point "d". As the operator begins to release the key, initial expansion displacement takes place along the same curve, but in the opposite direction-that is total displacement moves from point "d" to point "c". But thereafter the return or expansion displacement path is different from the initial or compression displacement path. As indicated by the dashed lines, the return path moves past point "c" to a smaller total displacement at point "e". At point "e" there is an abrupt vertical increase in restoring force with little, if any, change in displacement. This abrupt increase is shown in dashed lines from point "e" to point "f". This places the restoring force at point "f", which is located at a lower force level on the initial path than the level of reactive force at tactile drop-off (point "b").

The phenomenon known as hysteresis, which operates along a return path different from an initial path, is the basis for a key switch closure that reduces the problem of bouncing. As shown in FIG. 3, reduced bouncing is accomplished by tactile drop-off occurring during compression displacement from point "b" to point "c", which initiates switch closure, and by abrupt increase occurring during expansion displacement from point "e" to point "f" by restoring force, which initiates switch opening.

While there has been a variety of approaches employed to improve each of the three types actuator arrangements discussed, they all still tend to have deficiencies in one aspect or an other, including such things as: mechanical breakdown of parts (such as springs), high cost of manufacture (both piece cost and assembly cost), and undesirable chattering or bouncing requiring additional "de-bouncing" techniques. Consequently, there has been a variety of efforts in the art to overcome these deficiencies. But the need continues.

Experience has shown that in most instances key switches using a hysteresis type actuator provides significant advantages over actuator arrangements using the other two approaches, particularly in tactile feel and "de-bouncing". But prior art hysteresis arrangements use both springs and cups and are plagued by the same types of deficiencies as other resilient key switch response arrangements. Consequently, hysteresis type actuators have problems and are expensive to manufacture. They can involve over two hundred parts per keyboard. And these many parts can contribute to breakdowns over the life of the product.

Accordingly, there is a need for a simple and more effective hysteresis type key switch actuator arrangement.

SUMMARY OF THE INVENTION

An object of the invention is an improved hysteresis type actuator for key switching.

Another object of the invention is an improved elastomeric domed hysteresis type actuator for key switching.

Yet another object of the invention is a domed hysteresis type actuator arrangement with improved "debounce".

These and other objects are, in a broad sense, attained by a hysteresis key actuator and assembly that includes an opened ended hollow cover or cup of particular wall configuration made of elastomeric resilient material and that is overlaying an electrical switching region with its open end in surrounding relationship therewith. The cover according to the invention includes two cooperating wall portions. One wall portion is shaped to provide substantially linear resistive force during compression displacement of the cover toward the switching region during a key stroke and to provide substantially linear restoring force during expansion displacement of the cover away from the switching region. The second wall portion is shaped to undergo a snap or buckling toward the switching region at a predetermined compression displacement and to undergo a snap or buckling away from the switching region at a predetermined expansion displacement that is smaller in total displacement than the predetermined compression displacement. And the cover further includes an interior portion positioned and sized to move into the switching region upon snap action movement toward the switching region and to move out of the switching region upon snap action movement away from the switching region.

Advantages of the invention include simplicity of design, less expensive manufacture, lower possibility of breakdown, excellent tactile feel, and minimized chatter or bouncing.

DESCRIPTION OF THE PREFERRED EMBODIMENTS

Figure 4:
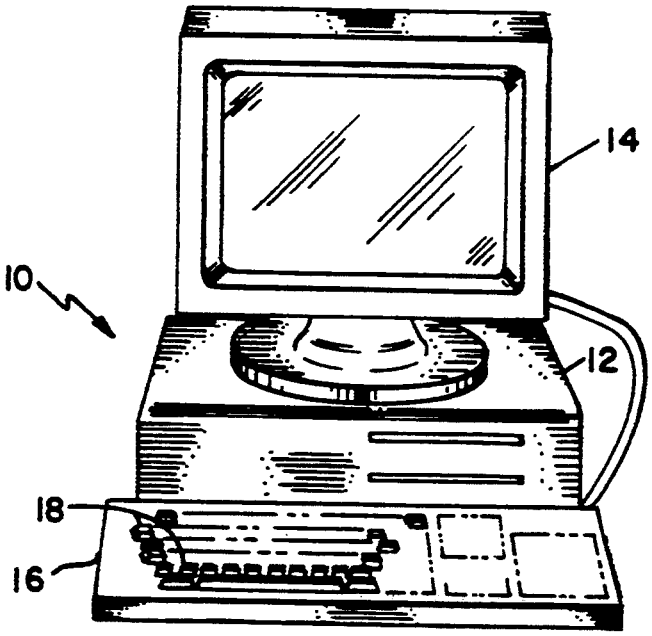
FIG. 4 shows a computer, monitor, and associated keyboard. The keyboard uses a hysteresis type resilient key switch actuator arrangement according to the principles of the invention.

FIG. 4 shows a work station 10 that includes a computer 12, a monitor 14, and a keyboard 16. The keyboard 16 includes individual keys 18. And the keys 18 each have an associated key switch and a resilient hysteresis key switch actuator arrangement or assembly 20, which is illustrated in FIG. 5.

Figure 5:
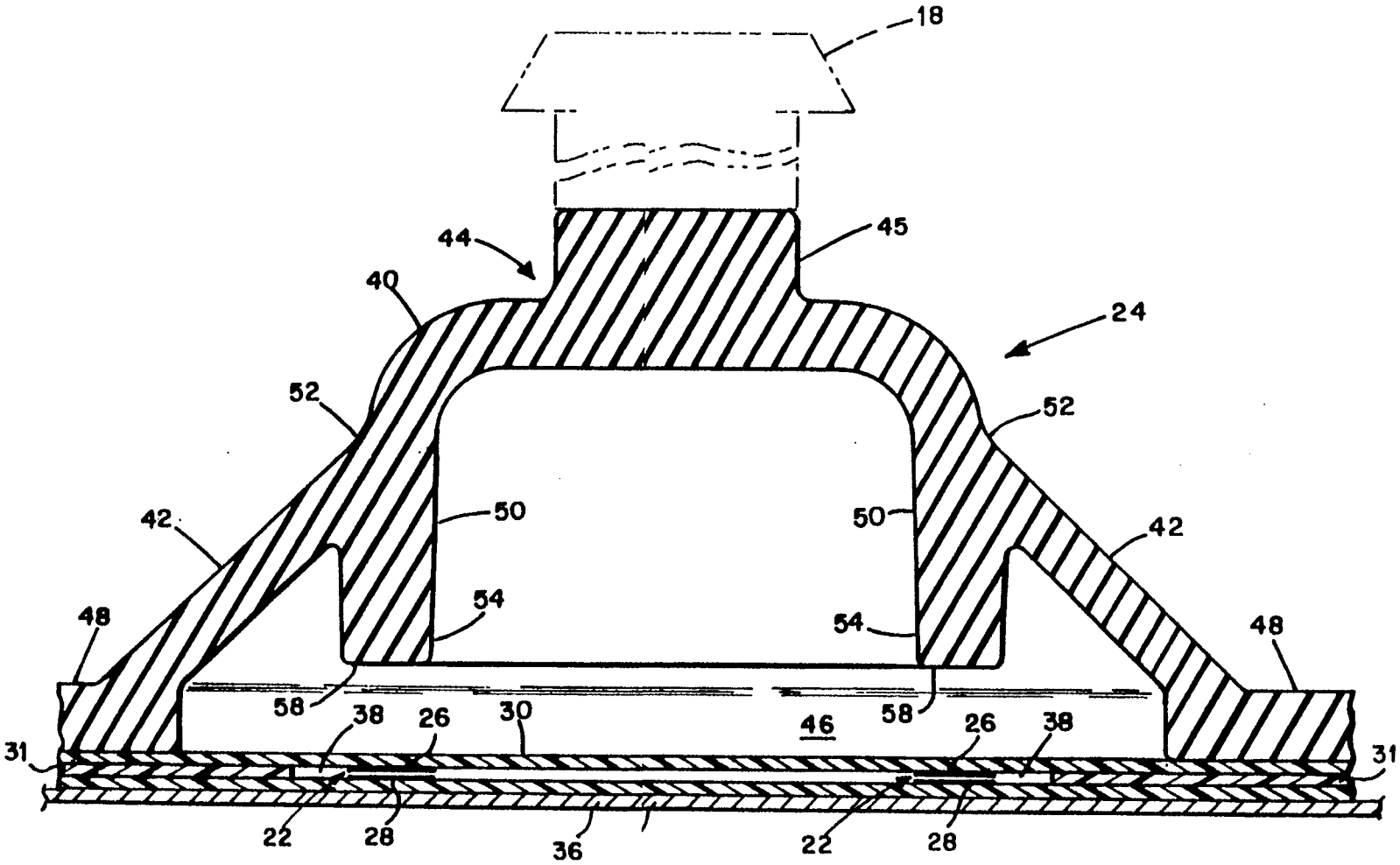
FIG. 5 is an elevation view, in section, of one the key switch and resilient key switch actuator assemblies of the keyboard shown in FIG. 4. The assembly includes a dome shaped actuator cup or cover and a key switch.

From FIG. 5, It can be seen that the assembly 20 includes a switching region with a key switch 22 and a resilient key switch actuator 24 in the form of a unitary hollow domed shaped cover or cup. As shown, the switch 22 includes a pair of electrical contacts 26 and 28 and three overlaying and touching mylar plastic sheets or layers 30, 31, and 32. The electrical contact 26 is on the underside surface of layer 30; the electrical contact 28 is on the upper surface of layer 32. As shown, the bottom wall 36 of the keyboard 16 supports the layer 32. In FIG. 5 the electrical contacts 26 and 28 are vertically aligned in a normally open position and are the same size and shape. They are annular in shape. Because the layer 31 has an opening 38, the plastic sheet 30 can be moved by the cover 24 during compression displacement to bring contacts 26 and 28 into electrical contact with each other when a keyboard operator depresses the key 18 (indicated in dashed lines).

The key switch 22 is in an electrical circuit (not shown).

The unitary hollow domed shaped cover or cup 24 has a particular wall configuration and is made of elastomeric resilient material, such as EPDM or silicone rubber. And it is disposed in overlaying relationship with the switching region with its switch 22. The cover 24 includes two cooperating sidewall portions: an upper linear sidewall portion 40 and a lower tactile sidewall portion 42. Moreover, the cover 24 has a closed upper or top portion 44 (which in some instances might advantageously be open) with an upstanding solid key contact pad 45. And the top portion 44 is in operative relationship with the key 18, which is located above the cover 24 in FIG. 5. The lower end 46 of the cover 24 is open and is in surrounding relationship with the switch 22. The cover 24 can be individual or, as shown, can be one of many cover regions of an elastomeric dome or boot sheet 48.

The sidewalls 40 and 42 of the cover 24 merge at an intermediate region 50. The lower tactile portion 42 joins with the upper portion 40 to form an outer transition area 52; an annular interior portion or annular foot 54 extends downwardly within the cover 24. The foot 54 is positioned and sized to close the electrical switch 22 during a key stroke by an operator. When a key stroke occurs, the key 18 is moved downwardly as viewed in FIG. 5. As a result, the cover 24 is compressed downwardly a sufficient amount to bring the foot 54 into engagement with the layer 30 to move the contact 26 into electrical contact with the contact 28, thereby closing the switch 22. When the operator begins to release the key 18, the cover 24 moves upwardly by restoring force to take the foot 54 out of contact with the layer 30—and the switch 22 opens.

Figure 1:
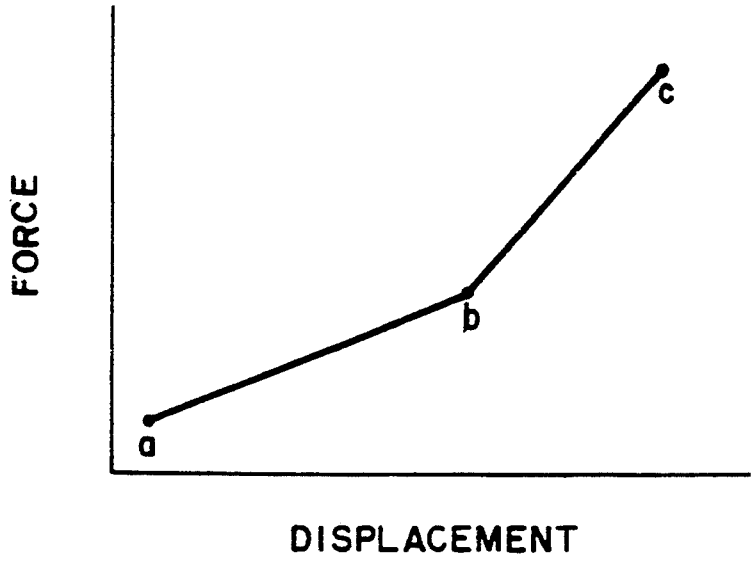
FIG. 1 is a graph showing a force displacement curve for a linear force type resilient key switch actuator arrangement.
Figure 2:
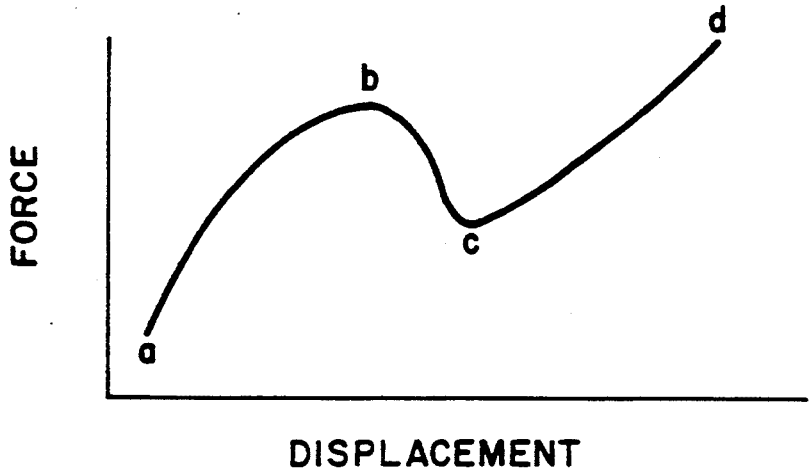
FIG. 2 is a graph showing a force displacement curve for a tactile type resilient key switch actuator arrangement.
Figure 3:
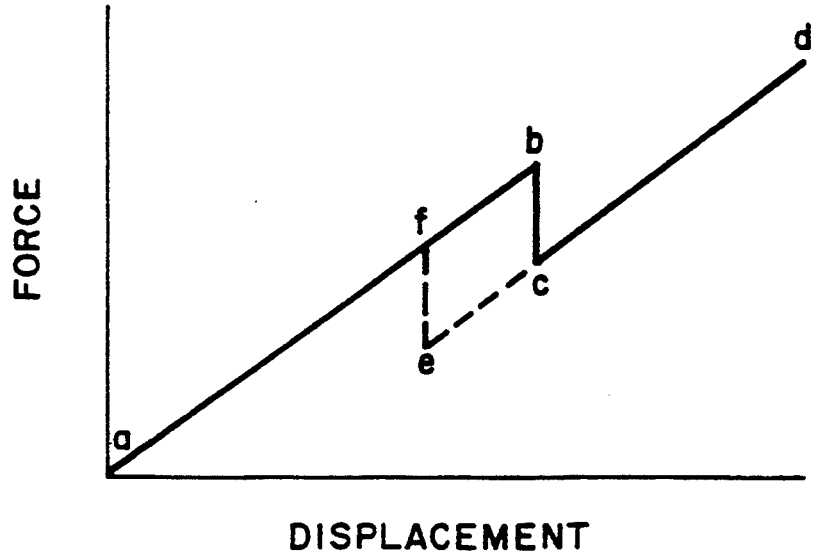
FIG. 3 is a graph showing a force displacement curve for a hysteresis type resilient key switch actuator arrangement.
Figure 6A:
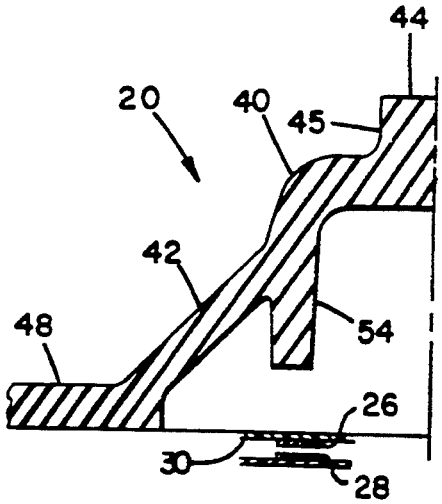
FIGS. 6*a*, 6*b*, 6*c*, and 6*d* are representations, in half section, of the resilient key switch actuator of FIG. 5 in various stages of actuator displacement occurring during a key stroke of one of the keys of the keyboard shown in FIG. 4.

Because the sidewall portions 40 and 42 of the cover 24 are configured as a hysteresis key switch actuator, the cover 24 operates to produce the type of displacement force curve shown in FIG. 3. But the operation of the cover 24 can be better understood by considering FIGS. 6*a*–6*d*. together with FIG. 3. FIG. 6*a* represents the cover 24 in its initial rest condition before any compression displacement during a key stroke. And this initial condition, with no displacement or force, is represented on the curve of FIG. 3 at point "a".

As a force is applied downwardly to the top portion 44 of the cover 24 by the key 18 at the initiation of a key stroke, the upper linear portion 40 is the first to react to compression as total displacement of the cover 24 moves from point "a" to point "b" along the curve of FIG. 3. As this initial compression displacement occurs, the linear portion 40 provides substantially linear resistive force as it undergoes a rolling or bending action downwardly. As can be seen in FIG. 3, this rolling action of linear portion 40 produces an increasing linear reactive force by the linear portion 40 resisting displacement. And this increasing reactive force is felt by the tactile portion 42 as downward pressure.

Figure 6B:
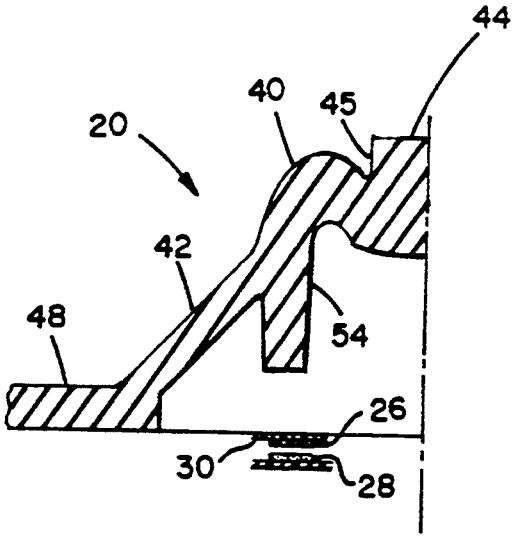

As compression displacement of the dome 24 approaches point "b" (by way of the rolling action of the linear portion 40), the action of the tactile portion 42 comes into play. The tactile portion 42 opposes the increasing downward pressure from the linear portion 40 without physical movement until compression displacement moves to point "b" on the curve of FIG. 3. At point "b" the tactile portion 42 provides a pronounced tactile drop-off as it undergoes a sharp collapse or buckling as a result of the increased downward pressure from the linear portion 40. This tactile drop-off is shown in FIG. 3 as the vertical drop from point "b" to point "c". FIG. 6*b* is a representation of the dome 24 where buckling or snap action of the tactile portion 42 is impending (just prior to arrival of total displacement to point "b"). By contrast, FIG. 6*c*. shows the dome 24 after snap action has occurred.

Referring to FIG. 3, tactile drop-off of an actuator, like actuator 24, is normally designed to occur with a downward displacement force of about 55 grams and at an intermediate total displacement of about 0.06–0.07 of an inch. This intermediate total displacement usually represents about one-half of the overall total displacement needed for an actuator, like the actuator 24, to move into a switching region to effect a switching action.

Figure 6C:
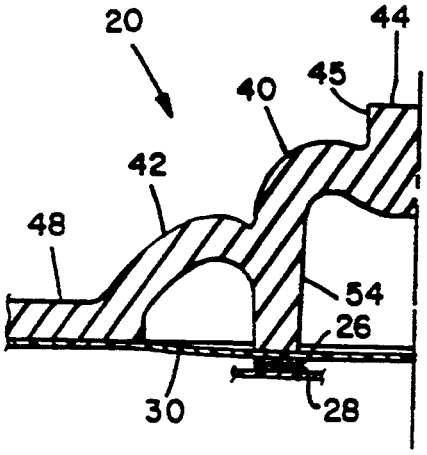

The annular interior foot 54 is positioned and sized to move into the switching region to close the switch 22 when the snap action downwardly occurs. That is, when the tactile portion 42 buckles during compression displacement of the cover 24, the foot 54 is thrust downwardly to move the layer 30 in a downward direction to bring contact 26 into electrical contact with contact 28 as shown in FIG. 6*c*. The position and size of the interior foot 54 is such that it does not enter the switching region to effect a switching action before buckling or tactile drop-off occurs.

Figure 6D:
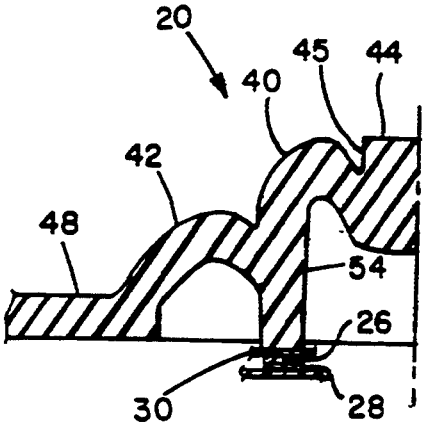

As the key stroke continues with compression displacement from point "c" to point "d", reactive force increases as shown on the curve of FIG. 3. The increasing reactive force against displacement is primarily the result of the rolling action of linear portion 40, which unrolls somewhat during the buckling action or tactile drop-off of the tactile portion 42. During this additional compression movement, the switch 22 remains closed as shown in FIG. 6*d*.

As the operator begins to release the key 18 at the end of a key stroke, restoring force moves along the curve of FIG. 3 with decreasing expansion or total displacement from point "d" past point "c" to point "e" as a result of unrolling of the portion 40. At point "e" the tactile portion 42 overcomes the reducing pressure from the linear portion 40. It snaps back or unbuckles to its original unbuckled condition, which causes some compression or rolling of portion 40. The result of this snap action upwardly away from the switching region is shown in FIG. 3 where restoring force jumps vertically from Point "e" to point "f". Thereafter the linear portion 40 continues its unrolling toward its original condition. This part of the operation of the cover 24 follows the curve of FIG. 3 from point "f", to point "a".

Figure 5A:
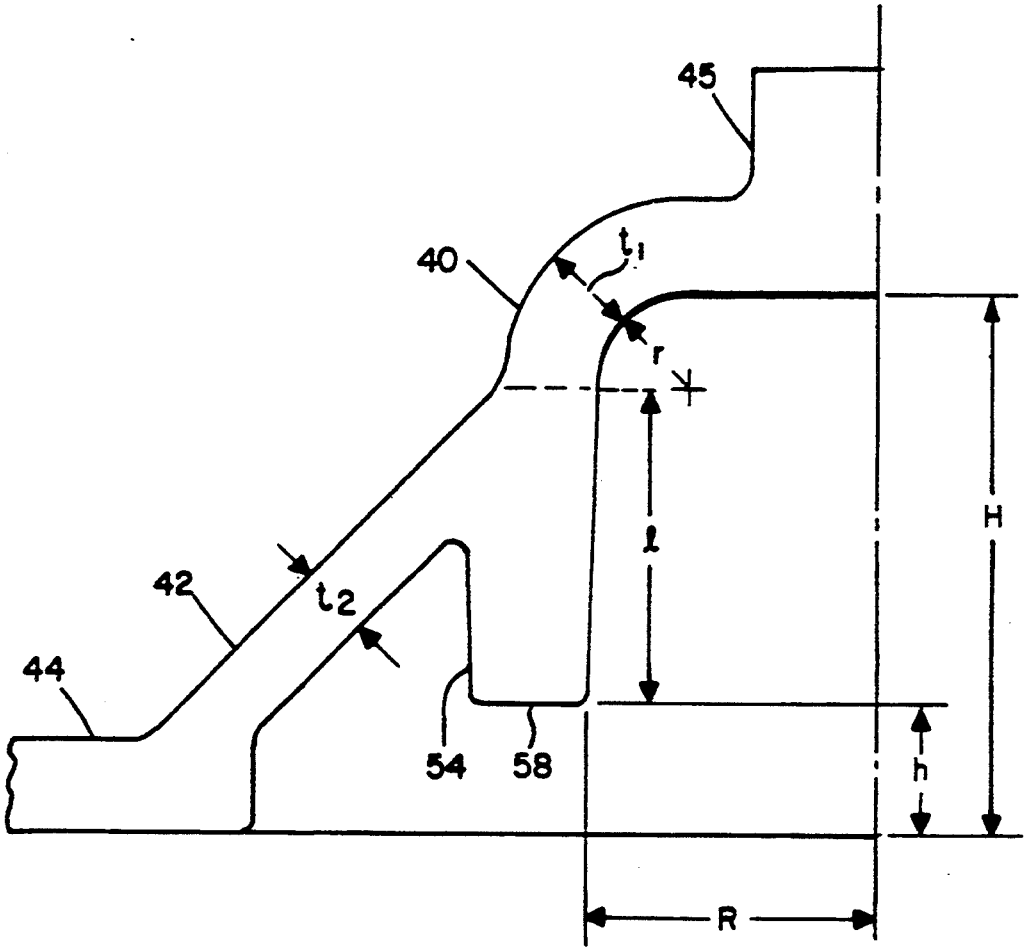
FIG. 5*a* is a half section representation of the resilient key switch actuator shown in FIG. 5 with various dimensions indicated.

Referring to FIG. 5*a*, various dimensions of the cover 24 are shown. The inside height of the cover 24 "H" above the opening at the open end 46 of the cover 24 is 0.213 of an inch and the height "h" of the contact surface 58 of the annual foot 54 above the opening at the open end 46 of the cover 24 is 0.050 of an inch. Moreover, the length "1" of the annular foot 54 is 0.125 of an inch and the radius "r" of the curve in the linear portion 40 is 0.038 of an inch. Further, the thickens "t1" of the linear sidewall portion 40 is 0.038 of an inch; the thickness "t2" of the tactile sidewall portion 42 is 0.030 of an inch.

Also, the cover 24, as shown, is molded of EDPM, but it can be made of other elastomeric resilient such material such as silicone rubber.

Referring to FIGS. 5 and 5*a*, the annular contacts 26 and 28 are made of conventional silver based conductive ink. Also, they are sized to have an outside radius of 0.150 of an inch and an inside radius of 0.125 of an inch. And they are in vertically spaced apart 0.005 of an inch when the switch 22 is open. As shown, the width of the annular surface of the foot is about twice the width of the contacts 26 and 28 for purposes of good contact. Moreover, other contact and actuator arrangements can be employed. For example, annular shapes and x shapes might be used. The goal is an arrangement that provides reliable contact.

In the embodiment shown in FIG. 5, the mylar sheets 30, 31, and 32 have a thickness of 0.005 of an inch.

The actuator arrangement as shown in FIG. 5 represents only one embodiment of the invention. In a broad sense, an actuator according to the invention includes any compressible cover of resilient elastomeric material shaped: to provide substantially linear resistive force during compression displacement toward a switching region and substantially linear restoring force during expansion displacement away from the switching region; and to undergo buckling toward the switching region at a predetermined compression displacement and unbuckling away from the switching region at a predetermined expansion displacement that is smaller in total displacement than the predetermined compression displacement. Moreover, the shape of the actuator makes it possible to move into the switching region at buckling and to move out of the switching region at unbuckling.

Accordingly, an actuator of the invention can have many shapes. In the embodiment of FIG. 5 the actuator is a unitary hollow dome shaped cover or cup 24. And the cover 24 is shown as circular in horizontal section. But in some instances it may be advantageous for a dome shaped cover to have planar sides or perhaps merely be raised in shape. Moreover, the linear portion 40 is disclosed as curved, but might be another shape. Similarly, the tactile portion 42 might have a shape other than straight.

Also, it is understood that materials, dimensions, thicknesses, and curves can be modified in conventional ways to provide desired key switch actuator feel in accordance with the principles of the invention.

Then too, the invention contemplates any number of switching arrangements. While FIG. 5 shows a particular type of contact switch arrangement, other switching arrangements, such as known capacitance switching, can be employed. Also, a portion of an actuator can be made conductive so as to function as a switch contact in a circuit. Accordingly, a portion of an actuator must merely be able to move into and out of a switching region to effect switching action at buckling and unbuckling of a tactile portion.

Figure 7:
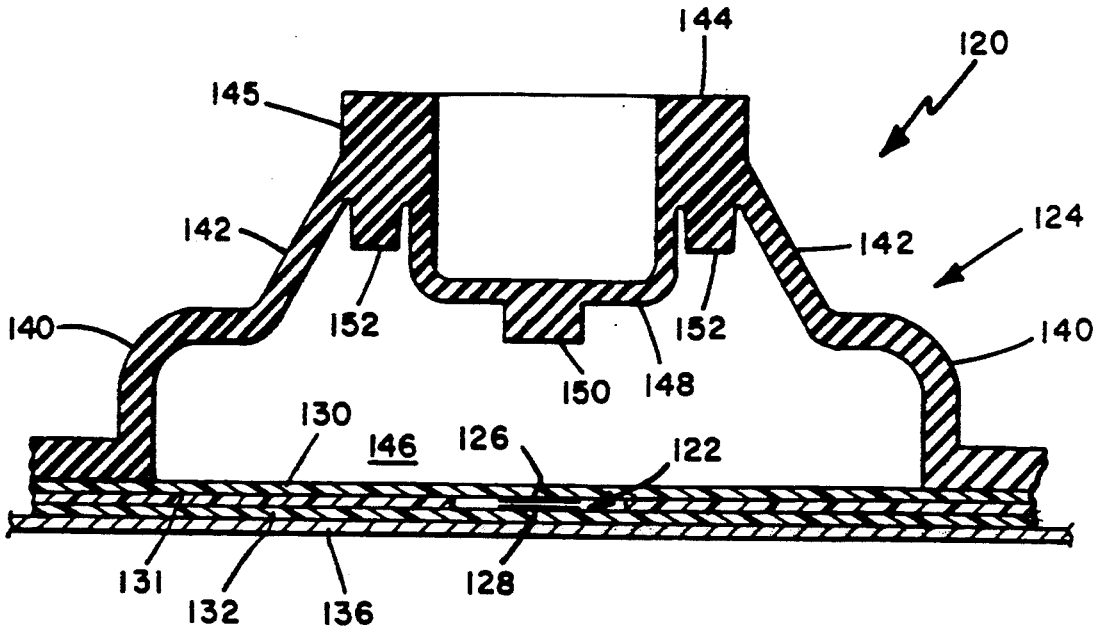
FIG. 7 is an elevation view, in section, of an alternate embodiment of a key switch and resilient key switch actuator assembly according to the principles of the invention.

FIG. 7 shows an alternate embodiment of the invention. It shows a hysteresis type resilient key switch actuator arrangement or assembly 120 that includes a switch 122 in a switching region and an actuator 124 in the form of a unitary resilient elastomeric domed shaped cover or cup.

As shown, the switch 122 includes a pair of electrical contacts 126 and 128 and three overlying and touching mylar plastic sheets or layers 130, 131, and 132. The electrical contact 126 is on the underside of the layer 130; the electrical contact 128 is on the upper surface of layer 132. As shown, keyboard bottom wall 136 supports the layer 132. Unlike the contacts 26 and 28 (which are annular in shape), the contacts 126 and 128 are point or spot contacts that can have any number of shapes, e.g. circular. As shown, they are vertically aligned. Because the middle layer 131 includes an opening 138, the layer 130 can be moved to bring the contacts 126 and 128 into electrical contact with each other during a key stroke.

The unitary hollow domed shaped cover 124 is disposed in overlaying relationship with the switching region with the switch 122 and includes two sidewall portions: a linear sidewall portion 140 and a tactile sidewall portion 142. But unlike the sidewall portions 40 and 42 of the cover 24, the linear portion 140 is the lower portion and tactile portion is the upper portion. Moreover, the cover 124 has a closed top end 144 with an upstanding collar 145. And the top end 144 is in operative relationship with a key, such as a key 18 (not shown), located above the cover 124. The cover 124 has an open lower end 146 that is in surrounding relationship with the switch 122 in the switching region. The top 146 of the cover 124 is configured to have an internal dome 148 that includes a central tip or foot 150 protruding downwardly from its lower closed end. The foot 150 is centrally located within the interior of the cover 124 and is aligned above the contacts 126 and 128 of the switch 122. Like the annular foot 54, the tip 150 is positioned and sized to move into the switching region to close the contacts 126 and 128 when it is moved downwardly during tactile drop-off and to move out of the switching region to open the contacts 126 and 128 during expansion of the cover 124.

The interior of the cover 124 is also shaped to include an annular bumper 152 encircling the internal dome 148. This bumper 152 is positioned and sized abut the bottom of the keyboard and thereby limit compression displacement of the cover 124 after tactile drop-off.

Figure 8B:
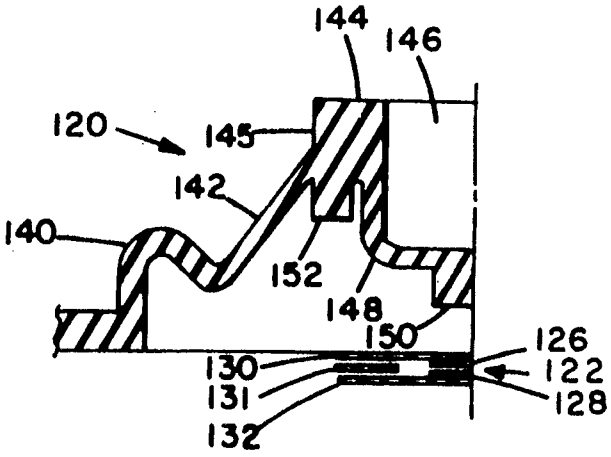
FIGS. 8*a*–8*d*. are representations, in half section, of the resilient key switch actuator of FIG. 7 in various stages of actuator displacement during a key stroke.
Figure 8A:
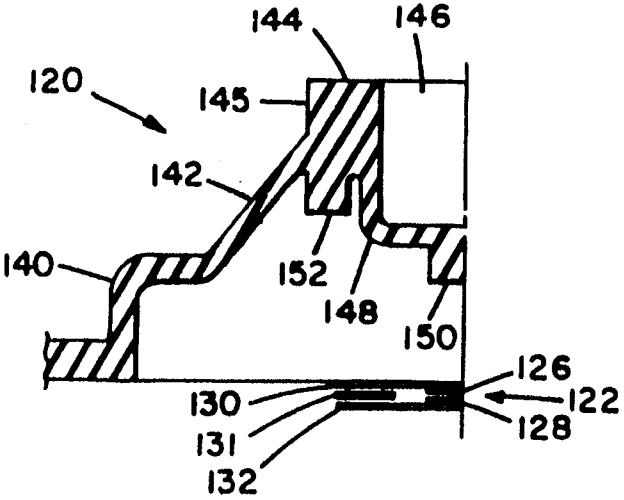

The operation of the cover 124 can be better understood by considering FIGS. 8*a*–8*d*. together with FIGS. 3 and 7. FIG. 8*a* represents the cover 124 in its initial rest condition before any displacement downwardly by a key stroke. This initial no displacement condition is represented on the curve of FIG. 3 at point "a".

As a force is applied downwardly on the top of the cover 124 at the initiation of a key stroke, the lower linear portion 140 is the first to react to compression displacement of the cover 124 shown as movement along the curve of FIG. 3 from point "a" to point "b". During this initial compression displacement the linear portion 140 provides substantially linear reactive force as it undergoes a downward rolling or bending action. And this rolling action produces an increasing reactive force resisting displacement. The increasing reactive force is felt by the upper tactile portion 142.

As compression displacement of the cover 124 approaches point "b " on the curve of FIG. 3, the action of the tactile portion 142 comes into play. It opposes the pressure of compression until displacement at point "b". Then the tactile portion 142 provides a pronounced tactile drop-off as it undergoes a sharp collapse or buckling as a result of the forces of compression applied to it. The tactile drop-off is shown in FIG. 3 as the vertical drop from point "b" to point "c". FIG. 9*a* is a representation of the cover 124 where buckling or snap action is impending (just prior to arrival of displacement at point "b"). By contrast, FIG. 8*b* shows the cover 124 after buckling has occurred.

Figure 8D:
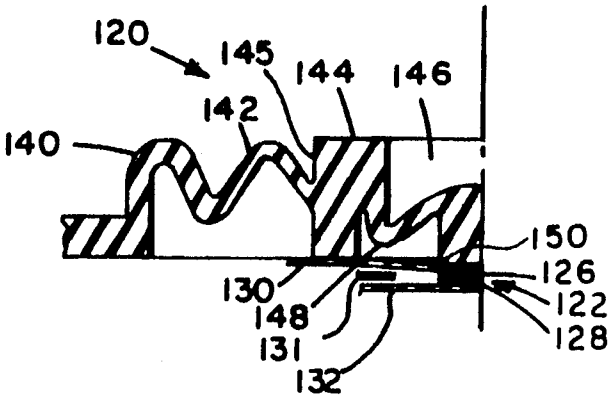
Figure 8C:
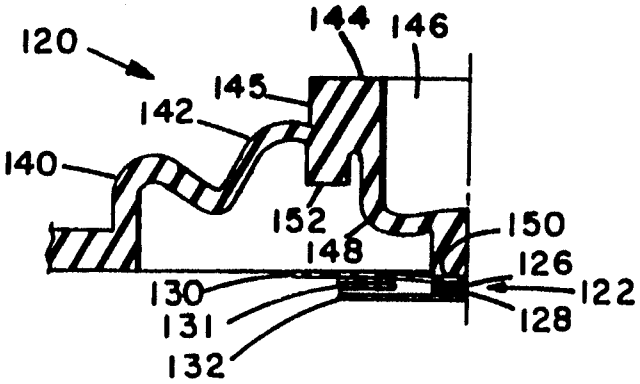

The interior size and configuration of the cover 124 is such that upon snap action downwardly the tip 150 is moved downwardly into the switching region to effect closing of the contacts 126 and 128. FIG. 8*c* shows the cover the cover 124 after snap or buckling action has occurred and the switch 122 is closed.

As the key stroke continues with compression displacement from point "c" to point "d", reactive force increases as shown on the curve of FIG. 3. This increase is primarily the result of compression displacement of the interior dome 148 because the bumper 152 is moved against the bottom of the keyboard at tactile drop-off as shown in FIG. 8*d*. During this additional displacement after tactile drop-off the switch 122 remains closed.

As the operator begins to release the key at the end of a key stroke, restoring force of the cover 124 moves along the curve of FIG. 3 with decreasing total or expansion displacement from point "d" past point "c" to point "e". At point "e" the tactile portion 140 overcomes the pressure being applied to it. It snaps back to its original unbuckled condition. The result of this abrupt snap action upwardly is the vertical jump in restoring force from point "e" to point "f" shown in FIG. 3. Thereafter, the lower linear sidewall portion 140 continues to unroll toward its initial condition. This final operation of the cover 124 follows the curve of FIG. 3 from point "f" to point "a".

Like the cover 24, the cover 124 is molded of a elastomeric resilient material, such as EDPM or silicone rubber.

Figure 7A:
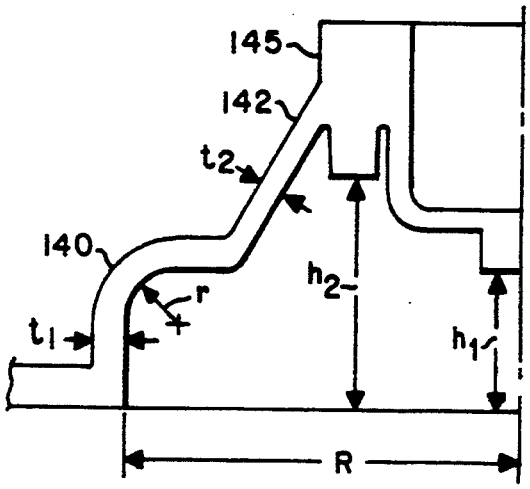
FIG. 7*a* is a half section representation of the resilient key switch actuator shown in FIG. 7 with various dimensions shown.

Referring to FIG. 7*a*, various dimensions of the cover 124 are shown. The height of the foot 150 "h1" above the layer 130 is 0.075 of an inch and the height "h2" of the bumper 152 is 0.125 of an inch. Moreover, the radius "r" of the curve in the linear sidewall portion 140 is 0.025 of an inch. The thickness "t1" of the linear sidewall portion 140 is 0.025 of an inch; the thickness "t2" of the tactile sidewall portion 142, 0.020 of an inch.

Still referring to FIG. 7*a*, the circular contacts 126 and 128 are made of silver based conductive ink. And they are vertically spaced apart when the switch 122 is open.

In view of the foregoing description of the invention, it will be understood that modifications and variations may be effected in the form of the invention without departing from its scope and spirit.

I claim:

1. A key switch and actuator assembly comprising:

An electrical switching region; and

A hollow arched actuator made of elastomeric material and having an open end, the actuator overlaying the electrical switching region and having its open end in surrounding relationship therewith, the actuator including a first wall portion shaped to provide substantially linear resistive force during compression displacement of the actuator toward the switching region and to provide substantially linear restoring force during expansion displacement of the actuator away from the switching region, the actuator further including a second wall portion located below the first wall portion shaped to undergo buckling toward the switching region at a predetermined compression displacement and to undergo unbuckling away from the switching region at a predetermined expansion displacement that is smaller in total displacement than the predetermined compression displacement, the actuator also including an interior portion positioned and sized to move into the switching region at the buckling of the second wall portion and to move out of the switching region at the unbuckling of the second wall portion.

2. A resilient key switch assembly comprising:

An electrical switch including two annular shaped normally open contacts of the same diameter; and A hollow closed topped dome shaped cover made of elastically resilient material, the cover having and open bottom end situated opposite the closed top, the cover overlaying the electrical switch with its open bottom end in surrounding relationship with the contacts of the switch, the cover including a first linear wall portion shaped to undergo a rolling action during compression displacement of the cover toward the contacts and to undergo an unrolling action during expansion displacement of the cover away from the contacts, the cover further including a second tactile wall located closer to the open bottom end than the linear wall portion, the tactile wall portion being shaped to undergo a buckling action toward the switch at a predetermined compression displacement and to undergo an unbuckling action away from the contacts at a predetermined expansion displacement that is smaller in total displacement than the predetermined compression displacement, the cover also including an annular shaped foot having substantially the same diameter as the contacts and in aligned relationship with them ,the foot being positioned within the cover to close the contacts at the buckling action of the second portion and to open the contacts at the unbuckling action of the second portion.

3. The resilient key switch assembly of claim 2 where the electrical switch comprises two annular shaped contacts and the interior portion of the dome shaped cover is annular shaped.

4. The resilient key switch assembly of claim 2 further including a bumper encircling the annular shaped foot.

* * * * *